US007350649B1

(12) United States Patent
Martens

(10) Patent No.: US 7,350,649 B1
(45) Date of Patent: Apr. 1, 2008

(54) PAPER SALES RACK WITH ADJUSTABLE MODULAR SHELVING

(76) Inventor: David A. Martens, #6, 2630 Bouquin Crescent W., Abbottsford, British Columbia (CA) V2S 5N7

( * ) Notice: Subject to any disclaimer, the term of this patent is extended or adjusted under 35 U.S.C. 154(b) by 472 days.

(21) Appl. No.: 11/028,816

(22) Filed: Jan. 3, 2005

Related U.S. Application Data

(60) Provisional application No. 60/533,987, filed on Jan. 2, 2004.

(51) Int. Cl.
*A47F 5/08* (2006.01)

(52) U.S. Cl. ..... 211/90.02; 211/150; 211/187

(58) Field of Classification Search ..... 211/150, 211/90.02, 187, 96, 174, 47; 108/6, 106, 108/107, 109, 110, 193
See application file for complete search history.

(56) References Cited

U.S. PATENT DOCUMENTS 3,534,863 A * 10/1970 Howard ..... 211/47
3,570,679 A * 3/1971 Edson ..... 211/47
4,540,222 A * 9/1985 Burrell ..... 312/257.1
4,688,681 A * 8/1987 Bergeron ..... 211/36
4,925,038 A * 5/1990 Gajewski ..... 211/59.2
5,349,909 A * 9/1994 Smit et al. ..... 108/107
5,427,255 A * 6/1995 Nook ..... 211/187
5,553,724 A * 9/1996 Moher et al. ..... 211/70.7
5,762,213 A * 6/1998 Heneveld, Sr. ..... 211/187
5,816,419 A * 10/1998 Lamson ..... 211/150

* cited by examiner

*Primary Examiner*—Jennifer E. Novosad
(74) *Attorney, Agent, or Firm*—Todd N. Hathaway

(57) ABSTRACT

A modular display rack that permits sheet paper products to be stored and displayed at a variety of heights, angles and spacings. The display rack includes a frame having sidewalls from which first and second parallel, spaced apart rows of pegs protrude inwardly. A plurality of detachable trays have rearward portions that detachably mount to the pegs of the rearward row in pivotable engagement therewith, and middle portions that rest atop the pegs of the forward row. The rows of pegs may be formed as elongate strips having base portions that are mounted to the sidewalls of the frame.

12 Claims, 4 Drawing Sheets

PAPER SALES RACK WITH ADJUSTABLE MODULAR SHELVING

RELATED APPLICATIONS

This application claims the benefit of U.S. Provisional Patent Application No. 60/533,987 filed on 2 Jan. 2004.

BACKGROUND a. Field of the Invention

The present invention relates generally to display racks for a retail sales environment, and more particularly to an adjustable modular display for retail sale of sheet paper.

b. Related Art

Effective display racks are an important component of most retail environments, enabling the shopper to conveniently view and select the products that they desire.

Many forms of display racks are consequently known, however, retail sale of specialty sheet paper products presents special challenges. By way of background, sale of specialty papers has enjoyed burgeoning success in recent years, with particular areas being sale of papers in scrapbook and crafts stores, as well as specialty papers in art supply stores. As a result, the variety of available papers has increased dramatically, from a few dozen to now several score or even hundreds in some specialty stores.

In the past, retail sales racks for sheet paper have conventionally taken the form of flat trays in racks or shelves, upon which the paper has been stacked. If a great many varieties are on offer, the spacing between the adjacent shelves or bins becomes very small, so that the paper is both difficult to view and reach. In some instances, retailers have resorted to the expedient of hanging a piece of the paper adjacent the bin for the shopper to view, however, this presents an obvious difficulty for the retailer and moreover valuable wall space is limited in most shops and stores. Similarly, expensive floor is also negatively impacted by the use of traditional flat, horizontal bins and shelves.

Moreover, traditional sheet paper sales racks have offered the retailer little or no flexibility in arranging and displaying the papers therein. For example, the retailer may wish to arrange the rack to display certain products more prominently under some conditions, or to hold more products under others, but this flexibility is simply not afforded by most display racks. Moreover, the varying nature of the products themselves often dictate that they be displayed in different manners, for example, it may be possible to display relatively heavy, stiff papers in angled shelving, while thinner tissues and other relatively "flimsy" papers require more horizontal storage, but again there is no way to adjust most existing display units to accommodate these varying needs.

Because of these factors, many retailers have found it necessary to have custom shelving and storage units constructed in order to properly store and display the various papers that they handle. However, this represents a considerable expense to the retailer, and moreover, it is often difficult or impossible to remove and reinstall the custom units in the event that the store relocates, which is a common occurrence for many retailers.

Accordingly, there exists a need for a retail display rack for sheet paper products that is readily adjustable to hold and display a variety of products in a suitable manner. Furthermore, there exists a need for such a display rack that presents the paper products to the customer in an attractive and easily viewable manner. Still further, there exists a need for such a display rack that makes sufficient utilization of valuable floor space in a retail environment. Still further, there exists a need for such a display rack that has a simplified, modular construction so that it can be made available at a reasonable price. Still further, there exists a need for such a display rack that can be readily removed, transported and installed in the event that the store relocates.

SUMMARY OF THE INVENTION

The present invention has solved the problems cited above, and is a modular display rack which permits the sheet paper products to be stored and displayed at a variety of heights, angles and spacings. Broadly, this comprises: a frame having first and second side walls; first and second parallel, spaced-apart rows of spaced-apart pegs mounted to the sidewalls so as to face inwardly therefrom; and a plurality of tray members having middle portions for being supported by the pegs of the forward row and rearward portions for detachably mounting to the pegs of the rearward row in pivotable engagement therewith.

The first and second rows of pegs may be formed as strips with integrally formed pegs, the strips being mounted to the side walls of the frame. The peg strips may be mounted by longitudinal insertion into dove-tailed grooves cut into the first and second side walls.

The tray members may each comprise a rearwardly opening fork portion for detachably engaging the rearward row of pegs in pivoting relationship therewith. The rearwardly opening fork portion may comprise a depending flange portion that extends downwardly and rearwardly from the main panel portion of the tray so as to define a receiving area for engaging the cylindrical pegs therein. The tray member may be formed of a rigid, resiliently flexible material, and the opening into the receiving area may be necked down so that the opening resiliently expands to permit entry of the peg and then resiliently returns to its original position so as to retain the peg and thereby hold the tray in place. Alternatively, the tray members may each comprise a forwardly-opening hook portion for detachably receiving the pegs of the rearward row in pivoting engagement therewith. The tray member may further comprise first and second edge notches formed forwardly of the hook portion for permitting passage of said pegs therethrough as a rearward end of said tray member is raised or lowered.

The tray may further comprise an upwardly projecting lip portion, for retaining a supply of paper therein and for permitting the tray member to be disengaged from the rearward pegs by pulling forwardly or pushing rearwardly thereon.

The frame may comprise first and second side walls, and top, bottom and rear walls. The side walls may taper from a relatively narrow top to a relatively wide bottom, so as to provide a broad footprint for stability of the assembly.

These and other features and advantages of the invention will be understood from a reading of the following detailed description with reference to the accompanying drawings.

DETAILED DESCRIPTION

Figure 1:
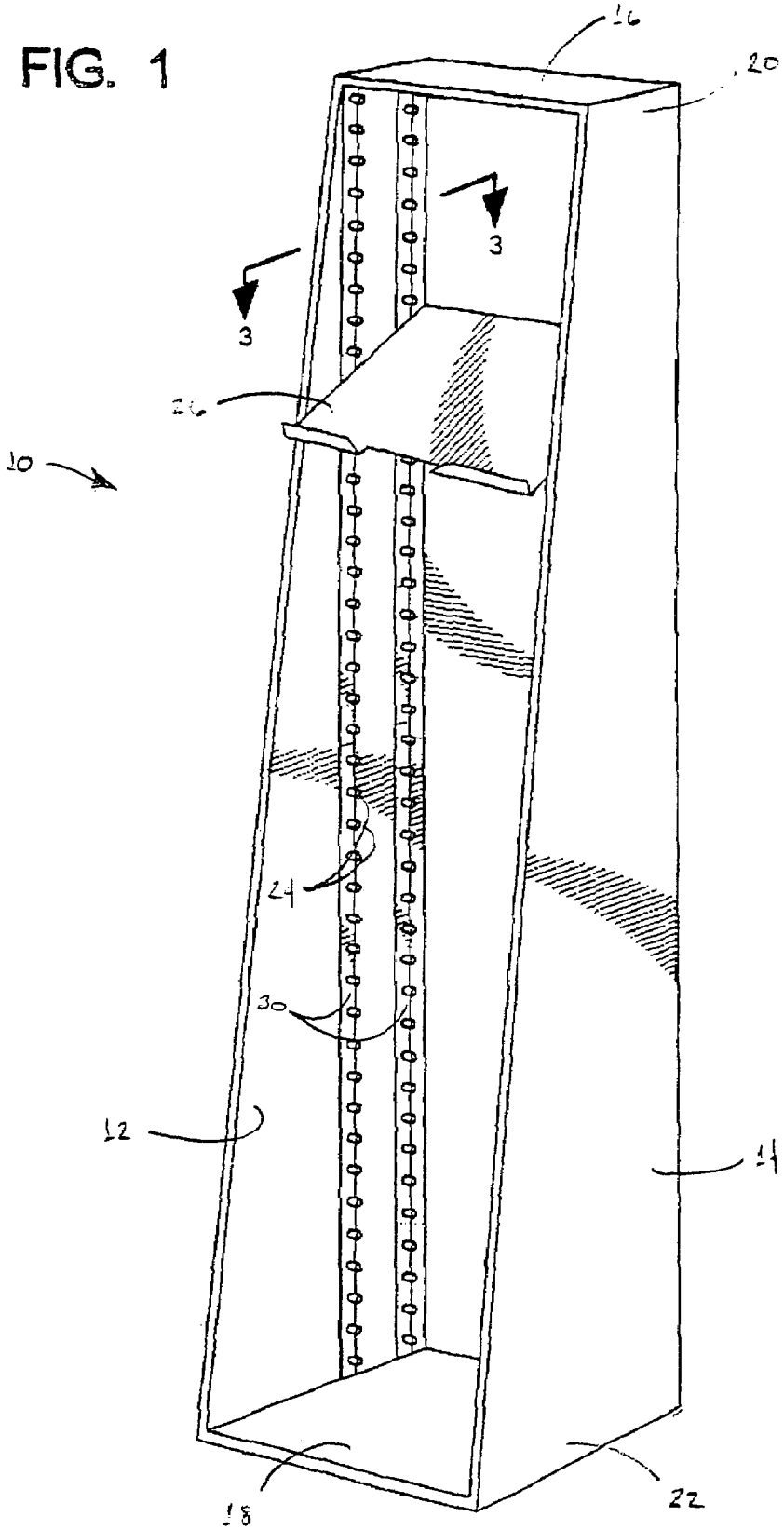
FIG. 1 is a front, perspective view of an adjustable paper display rack in accordance with the present invention, showing the rack one of the adjustable trays thereof installed.

FIG. 1 shows a retail paper display rack 10 in accordance with the present invention. As can be seen, this includes first and second side walls 12, 14 and upper and lower end walls 16, 18, the rear of the assembly being enclosed by vertical back wall 19. Although the shape of the individual walls are somewhat optional, and may be varied for aesthetic purposes and other design factors, has been found advantageous to use the tapering shape that is shown in FIG. 1, in which each of the side walls tapers from a comparatively narrow upper end to a comparatively wide lower end 22, with the upper and lower walls 16, 18, be sized accordingly, in that this is a clean design that provides a stable footprint for the assembly.

A plurality of pegs 24 project inwardly in rows from the side walls 12, 14 of the assembly, and provide attachment and support points for the shelf units 26. Unlike conventional shelving assemblies that employ pegs in holes drilled in the walls, the pegs 24 of the present invention are formed on strips 30 that are dovetailed into the side walls 12, 14 of the assembly. This provides significant advantages in both economy of manufacture and flexibility of the assembly. The strips 30 and pegs 24 can be formed integrally of molded plastic (with the length of the strips being shorter or longer depending on the capabilities of the interjection molding apparatus), or in other embodiments may be formed of wood or other metal using automated processes. The two parallel spaced dovetailed slots 32 are then simply cut into the side walls, and the peg strips 30 are cut to the desired length and slid into place. The top, bottom and back walls are then installed and the assembly is complete. This method of manufacture is much faster and less expensive than traditional techniques in which the side boards are typically drilled with jigs for installation of separate pegs. Moreover, the standardized peg strips of the present invention can be installed in sidewalls of different sizes and shapes, as will be described in greater detail below with reference to FIG. 5.

Figure 2:
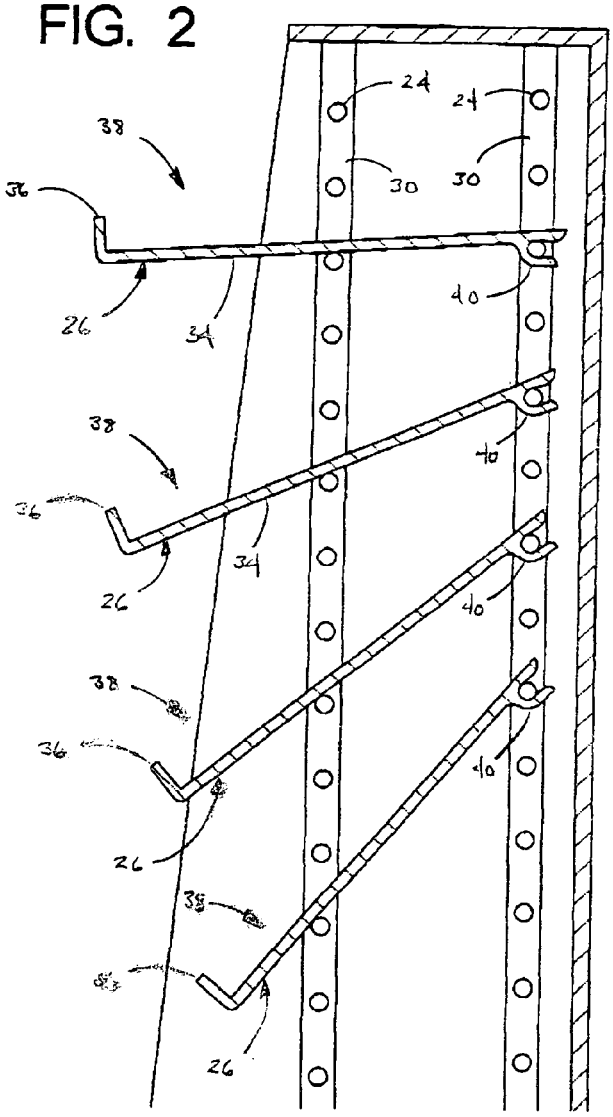
FIG. 2 is a side, cross-sectional view of the display rack of FIG. 1, showing the manner in which the shelf units thereof can be installed at a variety of angles so as to display various paper products at an optimal angle.

As can be seen in FIG. 2, the two peg strips are installed on the opposing side walls so that the levels of the pegs are slightly off-set, with those in the rearward row being slightly above the level of their mates in the front row. Both rows of pegs provide support for the spay trays 26, with the rearward row also providing pivotable attachment points for the trays.

As can be seen, each of the trays includes a generally flat main panel portion 34 having an upwardly projecting wall or flange 36 across its forward edge. The upper surface of each tray thus forms a retaining area 38 for holding a supply of paper.

Figure 4:
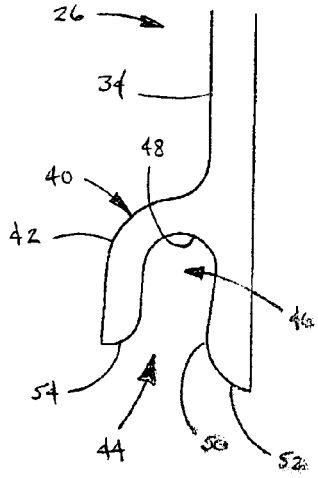
FIG. 4 is an enlarged, elevational view of the end of one of the shelf units of the rack assembly of FIGS. 1-2, showing the manner in which the shelf unit attaches to the rearward row of pegs in the assembly.
Figure 3:
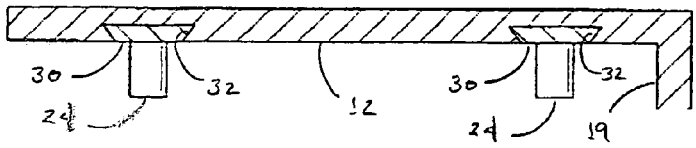
FIG. 3 is a top, cross sectional view of one wall of the display rack of FIG. 1, taken along line of 3-3 in FIG. 1, showing the manner in which the pegs that provide the attachment and support plates for the shelf units are formed on first and second strips that are dovetailed into the wall.

The lower surface of each of the panel portions, in turn, rests on the projecting pegs 24 of the forward and rearward peg strips so as to support the tray 26 thereon. In addition, a rearwardly opening mounting channel or fork 40 is formed along the rearward edge of each of the trays 26 for pivotable attachment to the rearward row of pegs. As can be seen in FIG. 4, the mounting fork is formed by flange portion 42 that extends downwardly from the main panel 34 from the tray and then rearwardly somewhat parallel to the panel, so as to define a rearwardly-facing opening 44. The opening leads into a receiving area 46 that is sized to receive the pegs 24 and has a semi-cylindrical inner wall 48 for establishing a pivoting interfit therewith. A downward protuberance 50 on the rearward edge of the main panel 34 necks the opening down to smaller than the diameter of the pegs 24, and the rearward edges 52, 53, panel and flange are tapered and rounded so as to guide the peg toward the opening.

The shelves 26 are formed of molded plastic or other material that has sufficient rigidity to support the paper therein, but also degree of resilient flexibility. Accordingly, as the shelf unit is pressed back against the rearward row of pegs, the flange portion 42 flexes downwardly to expand the opening 44, until the peg passes therethrough and into receiving area 46. The lower flange then "snaps" back into place to hold the peg in pivoting engagement with the receiving area. However, whenever the operator desires, the shelf can be detached from the peg by simply grasping the grip 36 of the shelf and pulling forward, reversing the process described above. The shelf unit can then be reinstalled in a different position or at a different angle as necessary, without requiring any modification of the structure.

As can be seen with further reference to FIG. 2, the spacing of the pegs and the two rows is selected to allow the angle of the trays to be adjusted simply by moving the tray so that the middle portion of its panel 34 is supported by the next lower or higher set of pegs. For example, the spacing of the pegs may be selected to allow an angular adjustment of five or ten degrees between positions. In the example that is illustrated in FIG. 2, the rearward row of pegs is offset slightly higher than the forward row (as noted above), so that in its initial position, with the tray attached to the rearward set of pegs and its middle portion resting on the next lower row in front, the tray is angled just slightly downwardly, e.g. by about five degrees. When the middle portion of the tray is supported by the next lower set of pegs in the forward row, as shown by the second tray from the top in FIG. 2, the downward angle of the tray is increased, e.g. to fifteen degrees, and so on. Adjusting the angle of the trays is easily accomplished by simply pulling the tray forwardly to detach it from the rearward row of pegs, as described above, then inserting through a lower opening between the pegs at the front of the assembly and reattaching it to its original (or another) set of pegs at the back.

Paper products can thus be displayed in the trays at various angles, and at various spacings, according to both the requirements of the product and the desires of the retailer. Moreover, the number of trays on display can easily be adjusted as desired.

Figure 5:
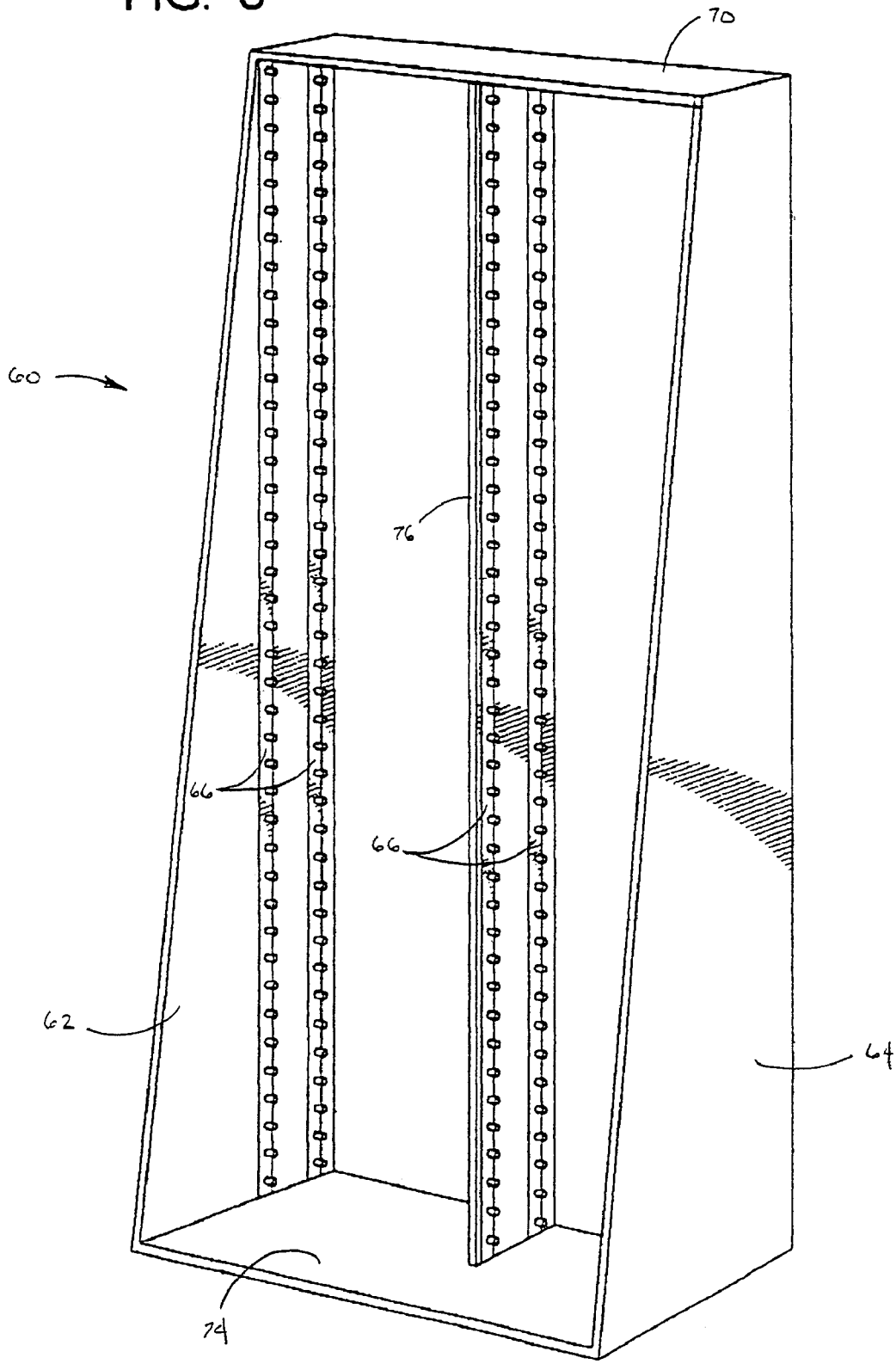
FIG. 5 is a front, perspective view of a second display assembly in accordance with the present invention, showing the manner in which the wall portions and peg strips of the assembly are utilized in a modular fashion to assemble display assemblies of different sizes.

FIG. 5 illustrates the manner in which the components described above can be utilized to construct display racks of different sizes and capacities in a modular fashion. In the enlarged display rack 60 that is shown in FIG. 5, which has double the capacity of that shown in FIG. 1, the sidewalls 62, 64 are identical to those used in the unit described above. The peg strips 66 and the manner in which they are installed are also identical. The only modifications necessary to achieve the enlarged capacity are wider top, bottom and back walls 70, 72, 74, and the addition of a central divider panel 76 having pegs strips 76 installed in dove-tailed grooves cut in at its opposing sides, in the same manner as that described above. The modular construction provided by the present invention thus facilitates the economical manufacture of display racks of different sizes and capacities.

Figure 6:
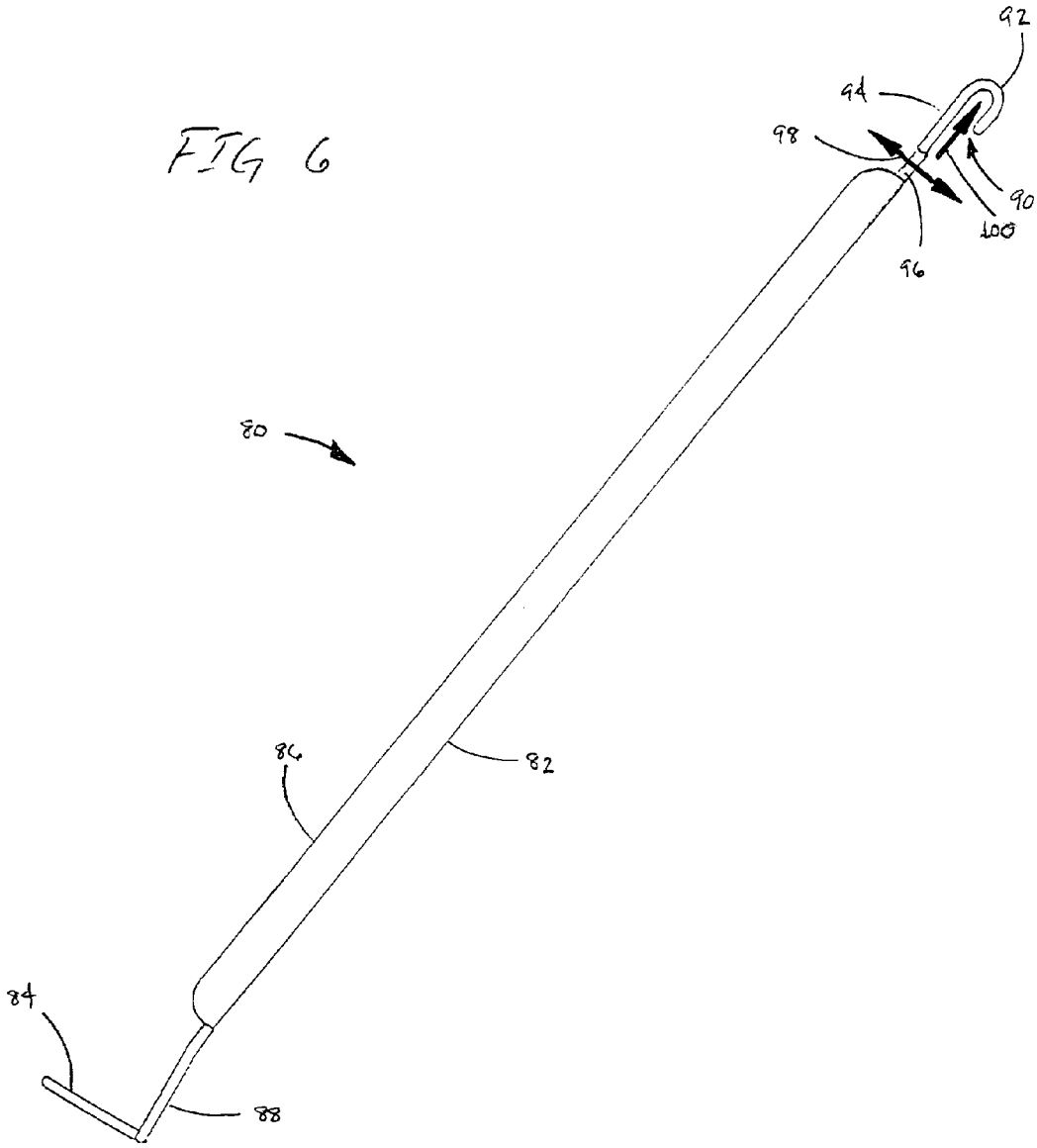
FIG. 6 is a side, elevational view of a shelf unit in accordance with a second embodiment of the invention, having forwardly-facing openings that receive the pegs rather than the rearwardly-facing openings of the shelf units shown in FIGS. 2 and 4.

FIG. 6 shows a shelf unit 80 in accordance with the second preferred embodiment of the present invention, for use in the display racks described above. In overall shape, the tray 80 is similar to the trays 26 described above, in that this includes a generally flat main panel portion 82 having an upwardly projecting wall or flange 84 across its forward edge and forms a retaining area for holding a supply of paper. In this case, the retaining area is bordered by first and second edge walls 86 (one only shown in FIG. 6) along the sides of the panel portion 82. In addition, the distal edge portion 88 of the main panel is depressed (i.e., bent) below the plane of the main surface of the panel in order to make it easier for the tip of a finger to slip part way under and lift the bottom most sheet or sheets from the shelf unit during use.

In contrast to the shelf units 26 shown in FIGS. 2 and 4, the shelf unit 80 has a forwardly facing peg opening 90 as opposed to the rearwardly facing opening 44 described above. As can be seen in FIG. 6, the peg opening 90 is defined downwardly and forwardly extending hook portion 92 that forms an extension of the upper edge 94 of the main panel 82. A depending wall (not shown) extends between the panel and the lip of the hook portion at the laterally inward sides of the openings 90, so as to form gussets that strengthen the hook portions and prevent them from spreading/cracking during use.

First and second notches 96 (one only showing in FIG. 6) are formed just forwardly of the hook portion 92, above the upper ends of the side walls 86. The notches are sized in width and depth to permit free passage of the pegs therethrough on either side of the shelf unit. This facilitates adjusting the angle of the shelf unit, since the pegs at the back of the frame can be slipped through the notches 96 as the rearward end of the shelf unit is raised/lowered, as indicated by arrow 98, and then attached to the selected set of pegs by sliding the shelf unit forwardly so that the pegs enter the opening 90 in the direction indicated by arrow 100.

Since the shelf units 80 are suspended from the pegs in openings 90, it is not essential that openings be bent down to provide a "snap" engagement as described above, however, such a feature may be included to promote a positive engagement between the pegs and shelf units 80 if desired.

It is to be recognized that various alterations, modifications, and/or additions may be introduced into the constructions and arrangements of parts described above without departing from the spirit or ambit of the present invention.

What is claimed is:

1. A display rack for sheet paper products, comprising:
- a frame having first and second side walls;
- forward and rearward substantially parallel, spaced-apart rows of vertically spaced pegs mounted to said side walls so as to face inwardly therefrom; and
- a plurality of detachable tray members having rearward portions that mount pivotably to said rearward row of pegs and middle portions that rest atop said forward row of pegs, said tray members each comprising:
  - a rearwardly-facing opening for detachably receiving said pegs of said rearward row in pivoting engagement therewith.

2. The display rack of claim 1, wherein said rows of pegs each comprise:
- elongate peg strips having continuous base portions formed integrally with said spaced-apart pegs, said base portions being mounted to said side walls of said frame.

3. The display rack of claim 2, wherein said base portions of said peg strips are mounted in dovetailed grooves formed in said first and second sidewalls of said frame.

4. The display rack of claim 1, wherein said rearwardly-facing opening comprises:
- a rearwardly-opening fork portion formed on a rearward end of said tray member for detachably engaging said pegs of said rearward row in pivoting relationship therewith.

5. The display rack of claim 4, wherein said rearwardly opening fork portion comprises:
- a depending flange portion that extends downwardly and rearwardly from a main panel portion of said tray member so as to define a receiving area for engaging said pegs therein.

6. The display rack of claim 5, wherein said tray members are formed of a rigid, resiliently flexible material.

7. The display rack of claim 6, wherein said rearwardly opening fork portion comprises:
- a necked down opening leading into said receiving area, so that said opening resiliently expands from an initial position to permit entry of a peg into said receiving area, and then resiliently returns to said initial position so as to retain said peg in said receiving area and hold said tray member in place in said frame.

8. The display rack of claim 7, wherein said tray member further comprises:
- an upwardly projecting lip portion that retains a supply of paper therein and that forms a handhold for permitting said tray member to be disengaged from said pegs of said rearward row by pulling forwardly thereon.

9. The modular display rack of claim 1, wherein said sidewalls of said frame taper from a relatively narrow top edge to a relatively wide bottom edge, so that said sidewalls provide a broad footprint for stability of said display rack.

10. The modular display rack of claim 9, wherein said frame further comprises:
- top and bottom walls mounted to upper and lower edges of said sidewalls; and
- a rear wall mounted to rearward edges of said side walls so as to enclose a rearward side of said display rack.

11. A display rack for sheet paper products, comprising:
- a frame having first and second side walls;
- forward and rearward substantially parallel, spaced-apart rows of vertically spaced pegs mounted to said side walls so as to face inwardly therefrom; and
- a plurality of detachable tray members having rearward portions that mount pivotably to said rearward row of pegs and middle portions that rest atop said forward row of pegs, each of said tray members comprising:
  - a hook portion at a rearward end of said tray member having a forwardly-facing opening for detachably receiving said pegs of said rearward row in pivoting relationship therewith; and
  - first and second edge notches formed forwardly of said hook portion for permitting passage of pegs of said rearward row therethrough as said rearward end of said tray member is selectively raised or lowered to adjust an angle of said tray member.

12. The modular display rack of claim 11, wherein said tray member further comprises:
- an upwardly projected lip portion that retains a supply of paper therein and that provides a hand grip for permitting said tray member to be disengaged from said pegs of said rearward row by pushing rearwardly thereon.

* * * * *